US008006422B2

(12) United States Patent
Riley

(10) Patent No.: US 8,006,422 B2
(45) Date of Patent: Aug. 30, 2011

(54) SELF-LAMINATING HANG TAG

(75) Inventor: James M. Riley, Saint Louis, MO (US)

(73) Assignee: Laser Band, LLC, St. Louis, MO (US)

( * ) Notice: Subject to any disclaimer, the term of this patent is extended or adjusted under 35 U.S.C. 154(b) by 129 days.

(21) Appl. No.: 12/252,654

(22) Filed: Oct. 16, 2008

(65) Prior Publication Data

US 2009/0094873 A1 Apr. 16, 2009

Related U.S. Application Data

(62) Division of application No. 10/870,500, filed on Jun. 17, 2004, now Pat. No. 7,520,077.

(51) Int. Cl.
*A44C 5/00* (2006.01)

(52) U.S. Cl. ..... 40/633; 40/665; 283/75

(58) Field of Classification Search ..... 40/633; 283/75, 900

See application file for complete search history.

(56) References Cited

U.S. PATENT DOCUMENTS

| | | | |
|---|---|---|---|
| 230,455 | A | 7/1880 | Wilcox |
| 919,983 | A | 4/1909 | Walsh |
| 922,948 | A | 5/1909 | Portmore |
| 1,383,335 | A | 7/1921 | Penksa |
| 1,517,456 | A | 12/1924 | Pulliam |
| 2,054,227 | A | 9/1936 | Nichols |
| 2,073,280 | A | 3/1937 | Lederer |
| 2,553,676 | A | 5/1951 | Roos |
| 2,641,074 | A | 6/1953 | Richmond |
| 2,687,978 | A | 8/1954 | Vogt |
| 2,914,166 | A | 11/1959 | Bihler |
| 3,153,869 | A | 10/1964 | Twentier |
| 3,197,899 | A | 8/1965 | Twentie |
| 3,402,808 | A | 9/1968 | Yannuzzi |
| 3,517,802 | A | 6/1970 | Petrie |
| 3,585,743 | A | 6/1971 | Jeffers |
| 3,660,916 | A | 5/1972 | McDermott et al. |
| 3,854,229 | A | 12/1974 | Morgan |
| 4,004,362 | A | 1/1977 | Barbieri |

(Continued)

FOREIGN PATENT DOCUMENTS

DE 202009015077 U1 1/2010

(Continued)

OTHER PUBLICATIONS

International Search Report for PCT/US2009/031979 dated Mar. 9, 2009.

(Continued)

*Primary Examiner* — Joanne Silbermann
(74) *Attorney, Agent, or Firm* — Thompson Coburn LLP

(57) ABSTRACT

A cushioned wristband includes a carrier having a multi-layered band portion and a strap sewn to the back of the band portion of the carrier. The band has a surface with loop material and the strap has a surface of hook material, the hook and loop surfaces being intended to secure the band in place as it is wrapped about a patient's appendage. The strap is appropriately sized to insert through one or both of two cinch slots of a self-laminating hang tag which may be printed with patient information and separated from a sheetlet or page sized business form processed through a printer for imaging of patient information thereon. The band portion of the carrier includes a cushioned layer of soft foamy or spongy material for contacting a patient's skin to thereby substantially eliminate any possibility for abrasion, rash, or other irritation or injury to the patient through wearing of the wristband.

9 Claims, 11 Drawing Sheets

U.S. PATENT DOCUMENTS

| | | | |
|---|---|---|---|
| 4,078,324 | A | 3/1978 | Wiebe |
| 4,179,833 | A | 12/1979 | Knodel |
| 4,226,036 | A | 10/1980 | Krug |
| 4,233,715 | A | 11/1980 | McDermott |
| 4,370,370 | A | 1/1983 | Iwata et al. |
| 4,565,731 | A | 1/1986 | Komatsu et al. |
| 4,612,718 | A | 9/1986 | Golub et al. |
| 4,627,994 | A | 12/1986 | Welsch |
| 4,630,384 | A | 12/1986 | Breen |
| 4,682,431 | A | 7/1987 | Kowalchuk |
| 4,696,843 | A | 9/1987 | Schmidt |
| 4,783,917 | A | 11/1988 | Smith et al. |
| 4,829,604 | A | 5/1989 | Allen et al. |
| 4,854,610 | A | 8/1989 | Kwiatek |
| 4,855,277 | A | 8/1989 | Walter |
| 4,914,843 | A | 4/1990 | DeWoskin |
| 4,941,210 | A | 7/1990 | Konucik |
| 4,950,638 | A | 8/1990 | Yuyama et al. |
| 4,956,931 | A | 9/1990 | Selke |
| D312,654 | S | 12/1990 | Giordano |
| 4,978,144 | A | 12/1990 | Schmidt et al. |
| 4,991,337 | A | 2/1991 | Solon |
| RE33,616 | E | 6/1991 | Welsch |
| 5,026,084 | A | 6/1991 | Pasfield |
| 5,045,426 | A | 9/1991 | Maierson et al. |
| 5,135,789 | A | 8/1992 | Schmidt |
| 5,222,823 | A | 6/1993 | Conforti |
| 5,227,004 | A | 7/1993 | Belger |
| 5,227,209 | A | 7/1993 | Garland |
| 5,283,969 | A | 2/1994 | Weiss |
| 5,311,689 | A | 5/1994 | Lindsey |
| 5,318,326 | A | 6/1994 | Garrison |
| 5,331,140 | A | 7/1994 | Stephany |
| 5,351,993 | A | 10/1994 | Wright et al. |
| 5,370,420 | A | 12/1994 | Khatib et al. |
| 5,381,617 | A | 1/1995 | Schwartztol et al. |
| 5,383,686 | A | 1/1995 | Laurash |
| 5,395,667 | A | 3/1995 | Ohno et al. |
| 5,401,110 | A | 3/1995 | Neeley |
| 5,418,026 | A | 5/1995 | Dronzek, Jr. et al. |
| 5,427,416 | A | 6/1995 | Birch |
| 5,486,021 | A | 1/1996 | Laurash |
| 5,486,436 | A | 1/1996 | Lakes |
| 5,509,693 | A | 4/1996 | Kohls |
| 5,509,694 | A | 4/1996 | Laurash et al. |
| 5,518,787 | A | 5/1996 | Konkol |
| 5,524,934 | A | 6/1996 | Schwan et al. |
| 5,547,227 | A | 8/1996 | Laurash et al. |
| 5,560,657 | A | 10/1996 | Morgan |
| 5,581,924 | A | 12/1996 | Peterson |
| 5,586,788 | A | 12/1996 | Laurash |
| 5,595,404 | A | 1/1997 | Skees |
| 5,596,202 | A | 1/1997 | Arakawa |
| 5,598,970 | A | 2/1997 | Mudry et al. |
| 5,601,222 | A | 2/1997 | Haddad |
| 5,601,313 | A | 2/1997 | Konkol et al. |
| 5,630,627 | A | 5/1997 | Stewart |
| 5,637,369 | A | 6/1997 | Stewart |
| 5,648,143 | A | 7/1997 | Mehta et al. |
| 5,653,472 | A | 8/1997 | Huddleston et al. |
| 5,662,976 | A | 9/1997 | Popat et al. |
| 5,670,015 | A | 9/1997 | Finestone et al. |
| 5,687,903 | A | 11/1997 | Akridge et al. |
| D391,991 | S | 3/1998 | Conner |
| 5,765,885 | A | 6/1998 | Netto et al. |
| 5,785,354 | A | 7/1998 | Haas |
| 5,842,722 | A | 12/1998 | Carlson |
| 5,877,742 | A | 3/1999 | Klink |
| 5,933,993 | A | 8/1999 | Riley |
| 5,984,363 | A | 11/1999 | Dotson et al. |
| 6,000,160 | A | 12/1999 | Riley |
| 6,006,460 | A | 12/1999 | Blackmer |
| 6,016,618 | A | 1/2000 | Attia et al. |
| D423,044 | S | 4/2000 | Burke et al. |
| 6,053,535 | A | 4/2000 | Washburn et al. |
| 6,055,756 | A | 5/2000 | Aoki |
| 6,058,639 | A | 5/2000 | Tinklenberg et al. |
| 6,067,739 | A | 5/2000 | Riley |
| 6,071,585 | A | 6/2000 | Roth |
| 6,092,321 | A | 7/2000 | Cheng et al. |
| 6,108,876 | A | 8/2000 | Hubbert |
| 6,155,476 | A | 12/2000 | Fabel |
| 6,155,603 | A | 12/2000 | Fox |
| 6,159,570 | A | 12/2000 | Ulrich et al. |
| 6,199,730 | B1 | 3/2001 | Chisolm |
| D448,404 | S | 9/2001 | Hamilton et al. |
| 6,303,539 | B1 | 10/2001 | Kosarew |
| 6,331,018 | B1 | 12/2001 | Roth et al. |
| 6,343,819 | B1 | 2/2002 | Shiozaki |
| 6,361,078 | B1 | 3/2002 | Chess |
| 6,364,366 | B1 | 4/2002 | Schwartz |
| 6,409,871 | B1 | 6/2002 | Washburn et al. |
| 6,438,881 | B1 | 8/2002 | Riley |
| 6,510,634 | B1 | 1/2003 | Riley |
| 6,517,921 | B2 | 2/2003 | Ulrich et al. |
| D473,264 | S | 4/2003 | Sanford et al. |
| 6,611,962 | B2 | 9/2003 | Redwood et al. |
| 6,641,048 | B1 | 11/2003 | Schintz et al. |
| 6,685,228 | B2 | 2/2004 | Riley |
| 6,748,687 | B2 | 6/2004 | Riley |
| 6,782,648 | B1 | 8/2004 | Mosher, Jr. |
| 6,807,680 | B2 | 10/2004 | Sloot |
| 6,836,215 | B1 | 12/2004 | Laurash et al. |
| 6,844,041 | B2 | 1/2005 | Squier et al. |
| D503,197 | S | 3/2005 | Stewart et al. |
| 6,863,311 | B2 | 3/2005 | Riley |
| 6,971,200 | B2 | 12/2005 | Valenti, Jr. |
| 6,981,948 | B2 | 1/2006 | Pellegrino et al. |
| 7,017,293 | B2 | 3/2006 | Riley |
| 7,017,294 | B2 | 3/2006 | Riley |
| D521,565 | S | 5/2006 | Stewart et al. |
| 7,047,682 | B2 | 5/2006 | Riley |
| 7,197,842 | B2 | 4/2007 | Ali |
| 7,222,448 | B2 | 5/2007 | Riley |
| 7,240,446 | B2 | 7/2007 | Bekker |
| 7,286,055 | B2 | 10/2007 | Girvin et al. |
| 7,523,576 | B1 | 4/2009 | Petty |
| D611,984 | S | 3/2010 | Ali et al. |
| 7,763,344 | B2 | 7/2010 | Riley et al. |
| 7,779,569 | B2 | 8/2010 | Riley et al. |
| 7,779,570 | B2 | 8/2010 | Riley |
| 7,784,209 | B2 | 8/2010 | Greer |
| 7,784,210 | B2 | 8/2010 | Riley et al. |
| 7,818,908 | B2 | 10/2010 | Greer |
| 7,823,310 | B2 | 11/2010 | Jain et al. |
| 7,877,915 | B2 | 2/2011 | Jain et al. |
| 7,883,018 | B2 | 2/2011 | Riley et al. |
| 7,918,045 | B2 | 4/2011 | Riley |
| 2002/0152928 | A1 | 10/2002 | Lawandy et al. |
| 2002/0176973 | A1 | 11/2002 | Keiser |
| 2003/0001381 | A1 | 1/2003 | Riley |
| 2003/0003249 | A1 | 1/2003 | Benim et al. |
| 2003/0011190 | A1 | 1/2003 | Ryan |
| 2004/0060216 | A1 | 4/2004 | Riley |
| 2004/0068906 | A1 | 4/2004 | Riley |
| 2004/0128892 | A1 | 7/2004 | Valenti |
| 2004/0148836 | A1 | 8/2004 | Riley |
| 2004/0244251 | A1 | 12/2004 | Riley |
| 2005/0091896 | A1 | 5/2005 | Kotik et al. |
| 2005/0108912 | A1 | 5/2005 | Bekker |
| 2005/0279001 | A1 | 12/2005 | Riley |
| 2005/0281989 | A1 | 12/2005 | Finger |
| 2006/0230661 | A1 | 10/2006 | Bekker |
| 2006/0236578 | A1 | 10/2006 | Saint et al. |
| 2006/0242875 | A1 | 11/2006 | Wilson et al. |
| 2006/0261958 | A1 | 11/2006 | Klein |
| 2007/0089342 | A1 | 4/2007 | Jain et al. |
| 2007/0120358 | A1 | 5/2007 | Waggoner et al. |
| 2007/0243361 | A1 | 10/2007 | Riley et al. |
| 2007/0257113 | A1 | 11/2007 | Davis et al. |
| 2008/0098636 | A1 | 5/2008 | Greer |
| 2009/0094872 | A1 | 4/2009 | Ali et al. |
| 2009/0193701 | A1 | 8/2009 | Greer |
| 2009/0277061 | A1 | 11/2009 | Jain et al. |
| 2009/0282717 | A1 | 11/2009 | Jain et al. |
| 2010/0071241 | A1 | 3/2010 | Jain et al. |

| | | | |
|---|---|---|---|
| 2010/0253060 | A1 | 10/2010 | Riley et al. |
| 2010/0281724 | A1 | 11/2010 | Greer et al. |
| 2011/0000114 | A1 | 1/2011 | Riley et al. |

FOREIGN PATENT DOCUMENTS

| | | | |
|---|---|---|---|
| EP | 1039431 | | 9/2000 |
| EP | 1974603 | A2 | 10/2008 |
| FR | 2806594 | A | 9/2001 |
| GB | 960859 | | 6/1964 |
| GB | 2045718 | | 11/1980 |
| GB | 2160492 | | 12/1985 |
| GB | 2228915 | A | 9/1990 |
| JP | 63175913 | A | 11/1988 |
| JP | 5-61777 | | 8/1993 |
| JP | 08-190350 | | 7/1996 |
| JP | 08299035 | A | 11/1996 |
| JP | 3032299 | | 12/1996 |
| JP | 10-207374 | | 8/1998 |
| JP | 11015383 | A | 1/1999 |
| JP | 2001316921 | A | 11/2001 |
| JP | 2002117190 | A | 4/2002 |
| JP | 2002351321 | A | 12/2002 |
| JP | 2003066849 | | 3/2003 |
| JP | 2003157010 | | 5/2003 |
| JP | 2003164307 | | 6/2003 |
| JP | 2006039209 | | 2/2006 |
| WO | 9502877 | | 1/1995 |
| WO | 96/12618 | | 5/1996 |
| WO | 98/23081 | | 5/1998 |
| WO | 99/18817 | | 4/1999 |
| WO | 02/39412 | | 5/2002 |
| WO | 03/003331 | | 1/2003 |
| WO | 2004/028826 | | 4/2004 |
| WO | 2005/064574 | | 7/2005 |
| WO | 2006/007356 | | 1/2006 |
| WO | 2007/021375 | | 2/2007 |
| WO | 2007/133906 | | 11/2007 |
| WO | 2008/079952 | A2 | 7/2008 |
| WO | 2009099787 | A1 | 8/2009 |
| WO | 2009/137195 | | 11/2009 |
| WO | 2010129131 | | 11/2010 |

OTHER PUBLICATIONS

International Preliminary Report on Patenability (Chapter II) for PCT/US2009/031979 issued May 21, 2010.
International Preliminary Report on Patentability (Chapter II) for PCT/US2009/039183 issued Apr. 20, 2010.
International Preliminary Report on Patentability (Chapter II) for PCT/US2008/059616 dated Jul. 14, 2009.
International Search Report for PCT/US2009/039183 dated Jun. 25, 2009.
International Search Report and Written Opinion for PCT/US2010/030361 dated Jul. 16, 2010.
International Preliminary Report on Patentability (Chapter I) for PCT/US2008/064972 dated Dec. 1, 2009.
Office Action for CA Application 2549631 dated Nov. 25, 2010.
Office Action for CA Application 2679181 dated Nov. 19, 2010.
Office Action for U.S. Appl. No. 12/847,271 dated Mar. 31, 2011.
Office Action for U.S. Appl. No. 12/115,945 dated Aug. 9, 2010.
Office Action for U.S. Appl. No. 12/819,709 dated Aug. 19, 2010.
Office Action for U.S. Appl. No. 11/455,131 dated Aug. 31, 2010.
Office Action for U.S. Appl. No. 12/627,227 dated Aug. 31, 2010.
Avery Dennison DuraCard.
Avery Laminated Identification Cards #5361.
Brochure entitled: "Color-Barâ—Click Stripä Labeling System"; Smead Manufacturing Company; Date Unknown; Form No. SSS-CS-00.
Brochure entitled: "Color-Bar â Folders"; Smead Manufacturing Company; Date Unknown.
Brochure entitled: "Integrated Document Management Software"; Smead Manufacturing Company; Date Unknown; Form No. SLI-95.
Catalog entitled: "Reseller Catalog No. One"; Smead Software Solutions ; Date Unknown; Form No. SSS-RC1-00.
Disaster Management Systems, Inc., Triage Tag, Copyright 1996, Pomona, California.
Gretchen Berry, "Wrist Watch," Advance for Healthcare Information Professionals, Feb. 15, 1999.
ID Warehouse (http://web.archive.org/web/20050131235601/http://idwarehouse.com/) Jan. 31, 2005. p. 1: WB1908, Stock Vinyl Wristband.
Maryland Department of Transportation, Maryland Emergency Medical Services, Triage Tag, Copyright MIEMMS 1999, Maryland.
Posey Movable I.D. Bracelet; downloaded from http:/www.posey.com/products/4648.html on Aug. 18, 2004.
Sample of Standard Register Labels.
Sample of Standard Register Label.
Standard Register, P.S. Magazine, Fall 1998, Dayton, Ohio.
"Yes, Sir, That's My Baby!," Material Management in Health Care, Feb. 1999, vol. 8, No. 2, Health Forum, Inc.
International Preliminary Report on Patentability (Chapter II) for PCT/US2010/030361 issued May 13, 2011.
Office Action for U.S. Appl. No. 11/373,923 dated May 17, 2011.
Office Action for U.S. Appl. No. 12/115,945 dated Jun. 2, 2011.
Office Action for U.S. Appl. No. 12/026,030 dated Dec. 9, 2010.
Office Action for U.S. Appl. No. 12/435,541 dated Oct. 29, 2010.
Office Action for U.S. Appl. No. 12/819,709 dated Nov. 8, 2010.
Office Action for AU Application 2006280450 dated Aug. 31, 2010.
Office Action for CN Application 03825215.5 dated Aug. 30, 2010.
Office Action for EP Application 03773060.3 dated Aug. 30, 2010.
Office Action for AU Application 2007317692 dated Aug. 12, 2010.
Office Action for CA Application 2567762 dated Apr. 11, 2011.
Office Action for CN Application 200680035179.8 dated Apr. 1, 2011.
Office Action for EP Application 03773060.3 dated Apr. 6, 2011.
Office Action for CA Application 2667271 dated Dec. 30, 2010.
Office Action for EP Application 01993920.6 dated Dec. 29, 2010.
Office Action for EP Application 05757812.2 dated Dec. 28, 2010.
Office Action for EP Application 07842781.2 dated Oct. 25, 2010.
Office Action for JP Application 2007-516565 dated Jul. 13, 2010.

24

SELF-LAMINATING HANG TAG

CROSS REFERENCE AND PRIORITY CLAIM TO RELATED APPLICATION

This application is a division of U.S. patent application Ser. No. 10/870,500, filed on Jun. 17, 2004.

BACKGROUND AND SUMMARY OF THE INVENTION

The inventor herein has previously invented multiple designs for self-laminating wristbands principally for use with patients in a medical or hospital setting. Examples of these may be found in his previously-issued U.S. Pat. Nos. 5,933,993; 6,000,160; 6,067,739; 6,438,881; 6,510,634; and 6,685,228 along with other patent applications pending for further designs, improvements, and inventive techniques and methods relating thereto, the disclosures of which are incorporated herein by reference. Included among these various inventions and designs are self-laminating wristbands intended for use with newborn babies including those delivered prematurely. As is well known, these babies and especially premature babies have extremely sensitive skin in many instances so that any wristband or other object placed around the baby's wrist or ankle must carefully allow for that sensitivity. Furthermore, babies are well known to move their arms and legs in a herky-jerky or flailing fashion, rub their eyes, and otherwise move about as they experience the new world that they have entered. In many instances, these newborn babies can become agitated and cry which can have a tendency to accentuate or intensify their arm and leg movements. Of course, as their hands, arms and legs move, they come in contact with other sensitive areas, such as, for example, their face, which could in some instances become scratched and in rare instances even injure the baby.

The inventor's previous designs include wristbands intended for these smaller babies including babies which might even be in intensive care and various features are provided to greatly minimize any possibility of discomfort, rash, or other injury to occur. Nevertheless, despite the great commercial success and widespread adoption and use of the inventor's wristband inventions, which have provided a significantly safer wristband for use with these babies, the inventor has continued his efforts to improve upon these designs even further so as to completely eliminate even the slightest possible chance of irritation or injury to the baby.

As a result of his continuing efforts, the inventor herein has succeeded in designing and developing a cushioned wristband which makes it virtually impossible for a baby who wears this wristband to experience a rash, discomfort, or even any injury as a result of the baby's boisterous conduct. In simple terms, this latest invention of a cushioned wristband includes a cushioned carrier for extending around the baby's wrist or ankle with a fastening strap preferably sewn to and extending from one side thereof. The strap preferably has one surface covered with Velcro™ hook-type fastener material while the carrier has a surface covered with Velcro™ loop material. The opposite surface of the carrier which comes into contact with the baby's skin is preferably any hypoallergenic, soft, cushioning material. The strap is preferably sized to thread through a self-laminating tag which may be processed through a laser printer and is similar in construction to many of the inventor's previous wristband designs. In essence, this self-laminating tag preferably comprises an imaging area of face stock material and an underlying self-laminating portion approximately twice the size of the imaging area with cinch slots preferably positioned in the lamination and preferably on either side of the imaging area. In use, the tag may be processed through a laser printer for printing with the patient's name, doctor's name, a barcode identifier, date of admission, and any other information as desired. The tag may then be separated from a sheetlet sized or page sized or other conveniently sized business form, the lamination folded over to self laminate the tag, and then applied to the carrier by inserting the strap through one or both of the cinch slots. Once fully assembled, the wristband may then be wrapped around the baby's wrist and the strap affixed to the back of the carrier by joining the hook and loop material of a Velcro™ fastener to thus secure the wristband to the baby. Preferably, the wristband is sized to allow for the cushioning material to wrap entirely around the baby's wrist, ankle, etc., and preferably overlap so that just the cushioning material contacts the baby's skin.

A somewhat similar prior art device is shown in FIG. 1. It comprises a wristband 100P made of cushioning material 102P with a backing of Velcro™ loop material 104P, with a short strap 106P sewn to one side thereof and having a Velcro™ hook material 108P arranged for securing the wristband. Sewn on the back of the wristband is a panel 110P to which a patient label 112P may be adhered. This patient label 112P may be provided as part of another form and printed such as by processing through a laser printer. It is noted that the patient label is exposed and not laminated, thereby requiring it to be made of a resilient material such as a vinyl or other durable material to withstand the moisture, body fluids and other abuse it will receive. Furthermore, there is no positive or mechanical attachment of the patient label to the wristband so that as it becomes worn and abused, the patient label is likely to become illegible or even detach which could lead to failure of the wristband in its essential purpose of reliably identifying the baby. With the wristband of the present invention, the cinch slots provide a positive mechanical attachment of a laminated patient label which makes it virtually impossible for it to become illegible or detached, thereby providing dramatically improved performance. The prior art patient label is not conveniently removed for refreshing the patient label with a new one, and instead it is thought that a new patient label would need to be adhered over the top of the existing patient label. This construction leads to attachment of a second patient label in a manner less secure than the original, unless extreme care is taken to prepare the panel for receiving the new patient label which is unlikely to happen in the hospital environment. Nurses have better things to do with their time than clean and prepare surfaces for receiving a new patient label. With the present invention, refreshment of a patient label is rarely necessary, and if necessary, can be achieved in a few steps by removing the wristband, sliding off the old patient label and sliding on the new patient label, and then replacing the wristband back on the baby. No cleaning of a surface, or peeling of the old label, is required. Furthermore, the replacement patient label is secured just as well as the original patient label. The present invention thus represents a dramatic step forward over this prior art construction.

There are many new features and advantages provided by the present invention. Some of these include the following. The self-laminating tag may be conveniently provided on a sheetlet or full-page size form for convenient processing through a laser printer at the time of admission along with other forms including other wristbands and labels as may be later used for the baby. Thus, the advantages as noted in the inventor's prior patents are carried forward with this invention in that regard. The self-laminating tag may be firmly secured either loosely or closely about the baby's wrist or ankle with only a cushioning material contacting the baby's skin to thereby provide reliable identification with a durable tag yet without any discomfort to the baby. The carrier is adjustable as it can be wrapped around itself to provide a variable length so that it may be used with babies of different size or age. In other words, the wristband carrier is sized and arranged with its hook and loop fastener to be adjustable in length and fit either loosely or tightly to the baby's appendage. The hang tag may be attached with either one or both of the cinch slots, as desired. If attached with a single cinch slot, the tag in essence is free to move with respect to the wristband and thereby be more readily accessible and remain flat for easier bar code scanning. If attached with the strap extending through both slots, the tag may be secured more tightly against the carrier, less subject to inadvertent detachment, and less likely to be inadvertently brought into contact with the baby. The wristband is relatively inexpensive yet durable and flexible in that, should a tag be desired to be changed as a result of heavy abuse, it may be conveniently done without reprocessing in many instances as additional tags may be conveniently printed at the time of admission. By being self laminating, the tag is protected from the various bodily fluids likely for it to come in contact with as the baby is fed or administered medicine orally, the baby drools, and the baby otherwise performs its bodily functions. As the hang tag is detachable, the carrier may be reused as desired or in shortage or emergency situations thereby making the entire wristband system more flexible. Indeed, the carrier may itself be washed in that same regard. The hang tag may be provided as part of a larger assemblage of wristband forms such that a single set of forms may be preprinted and available for usage as the baby's stay progresses and even to accommodate those relatively few occasions when the baby is kept for an extended stay.

While the principal advantages and features of the invention have been briefly described above, a more thorough understanding and appreciation for the invention and its advantages may be obtained by referring to the drawings and description of the preferred embodiment which follow.

BRIEF DESCRIPTION OF THE DRAWINGS

FIG. 2(A) shows the layout of the whole form, and FIGS. 2(B)-2(C) show exploded views.

FIG. 3(A) shows the layout of the whole form, and FIGS. 3(B)-3(E) show exploded views.

DETAILED DESCRIPTION OF THE PREFERRED EMBODIMENT

Figure 2A:
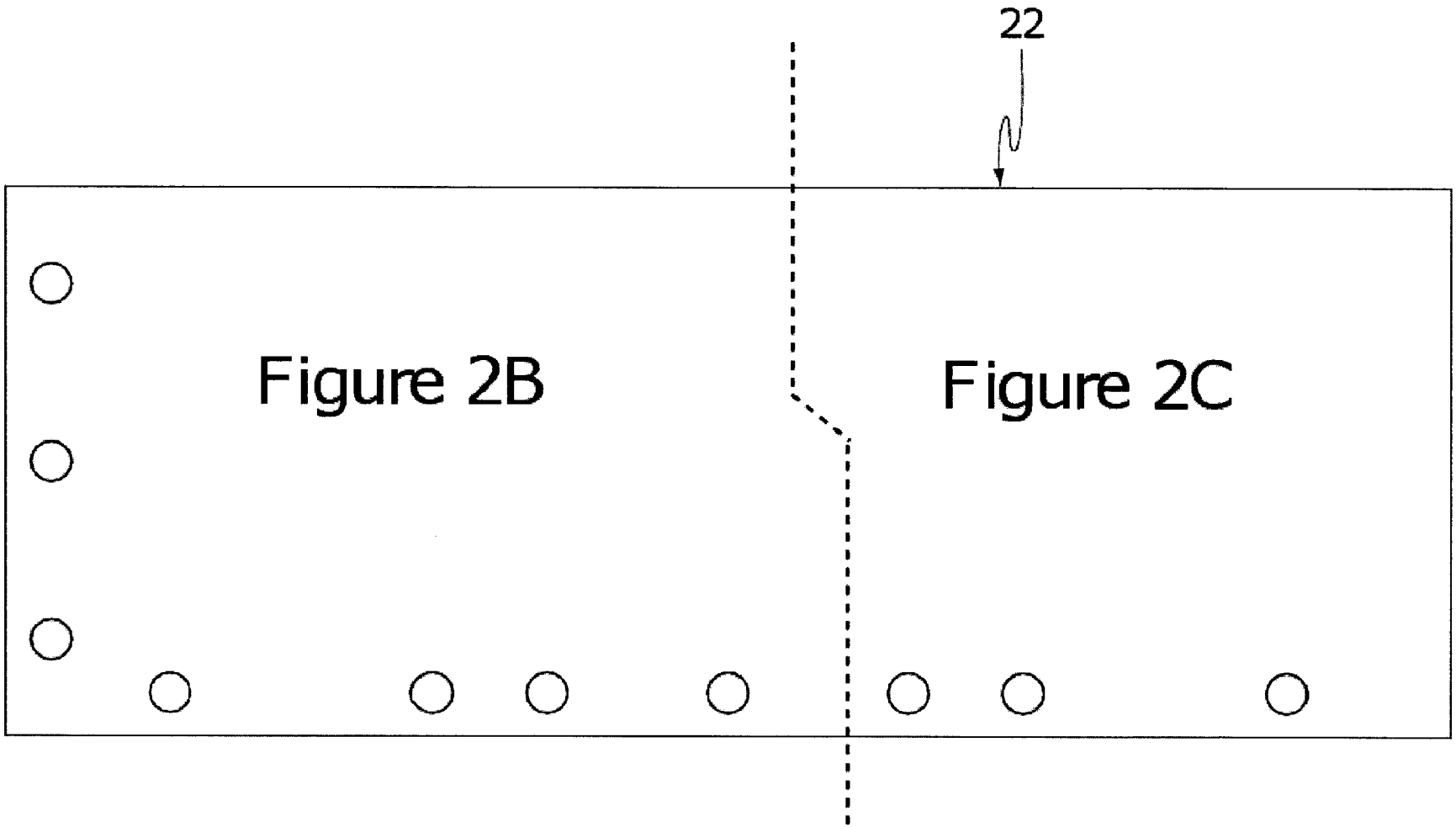
FIGS. 2(A)-2(C) are top views of a sheetlet sized business form having a pair of self-laminating wristbands and a pair of self-laminating hang tags for use with the cushioned carrier as shown in FIG. 4.
Figure 2B:
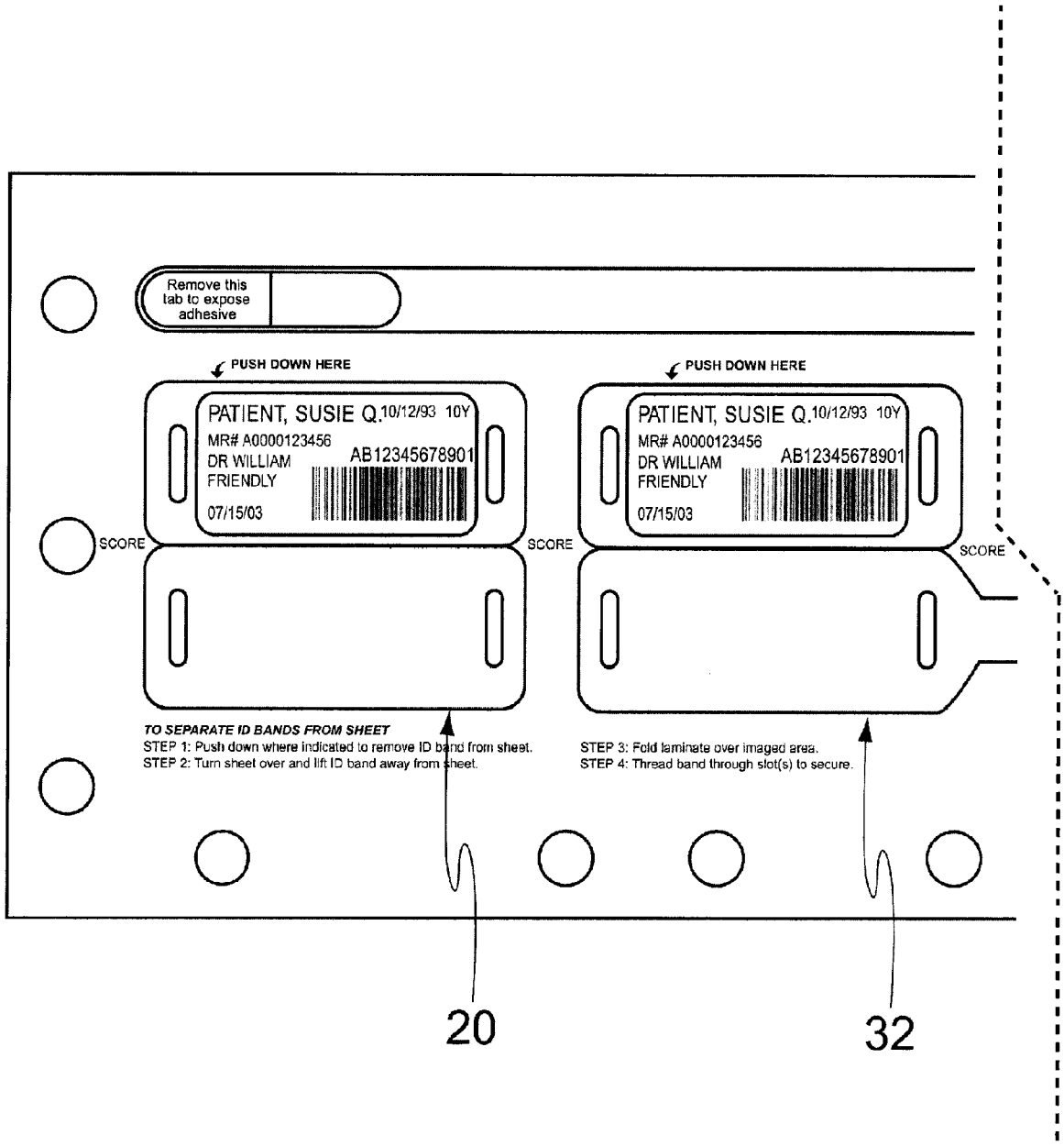
Figure 2C:
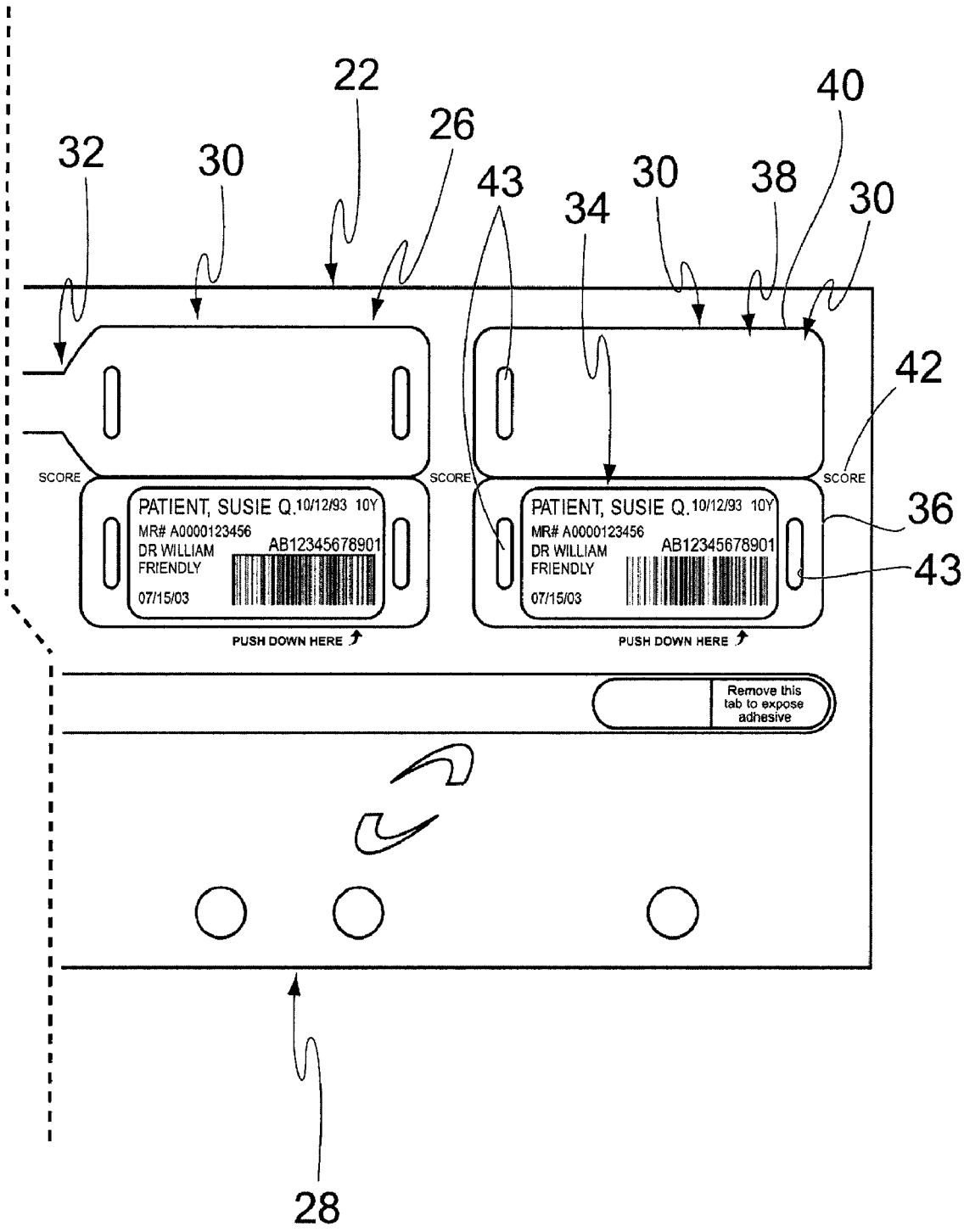
Figures 3A, 3B, 3C, 3D, 3E:
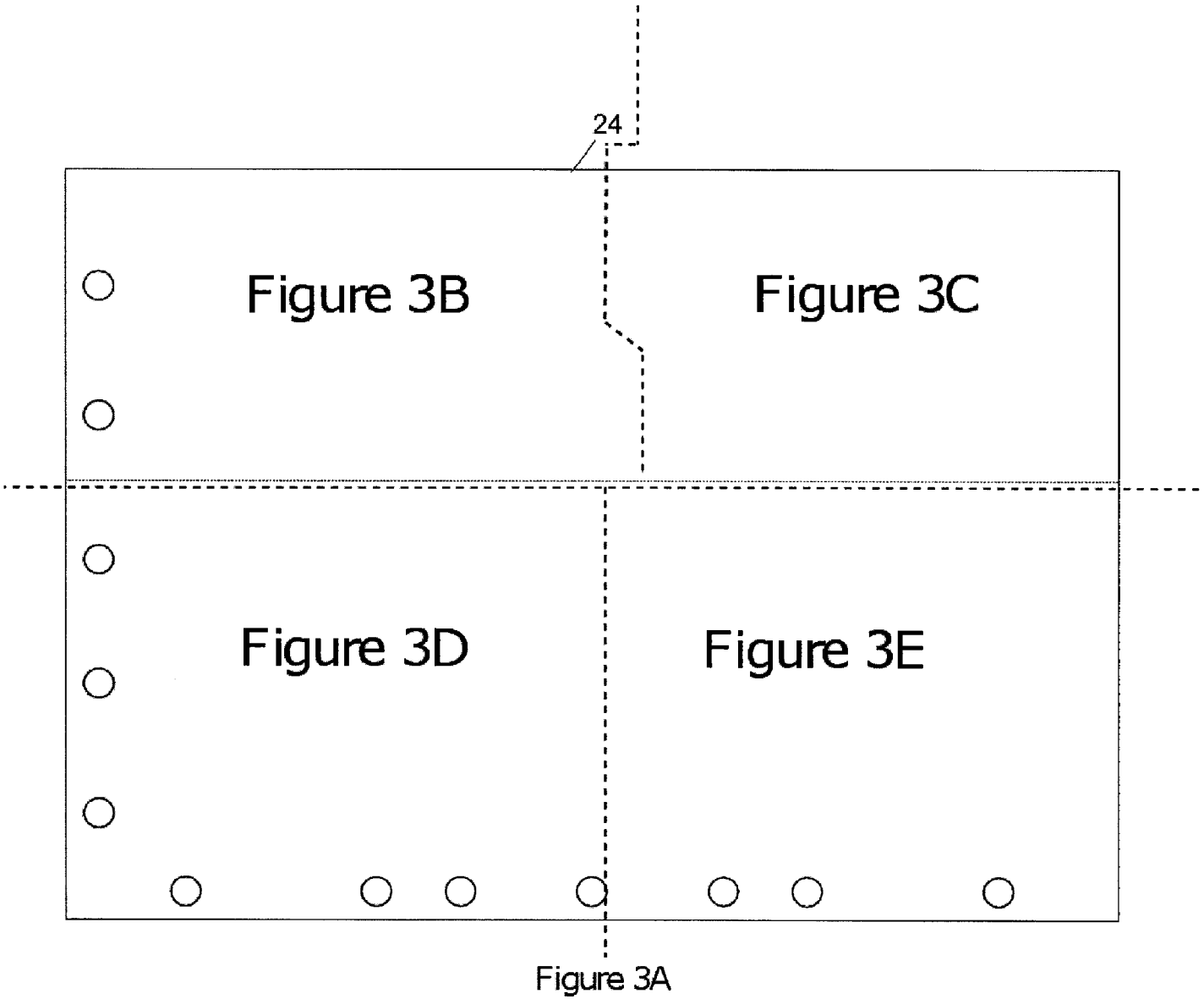
FIGS. 3(A)-3(E) are top views of a full-page sized "combo" form having an upper portion containing a pair of self-laminating wristbands as well as a pair of self-laminating hang tags and a bottom portion having a matrix of printable self-adhesive labels.
Figure 3B:
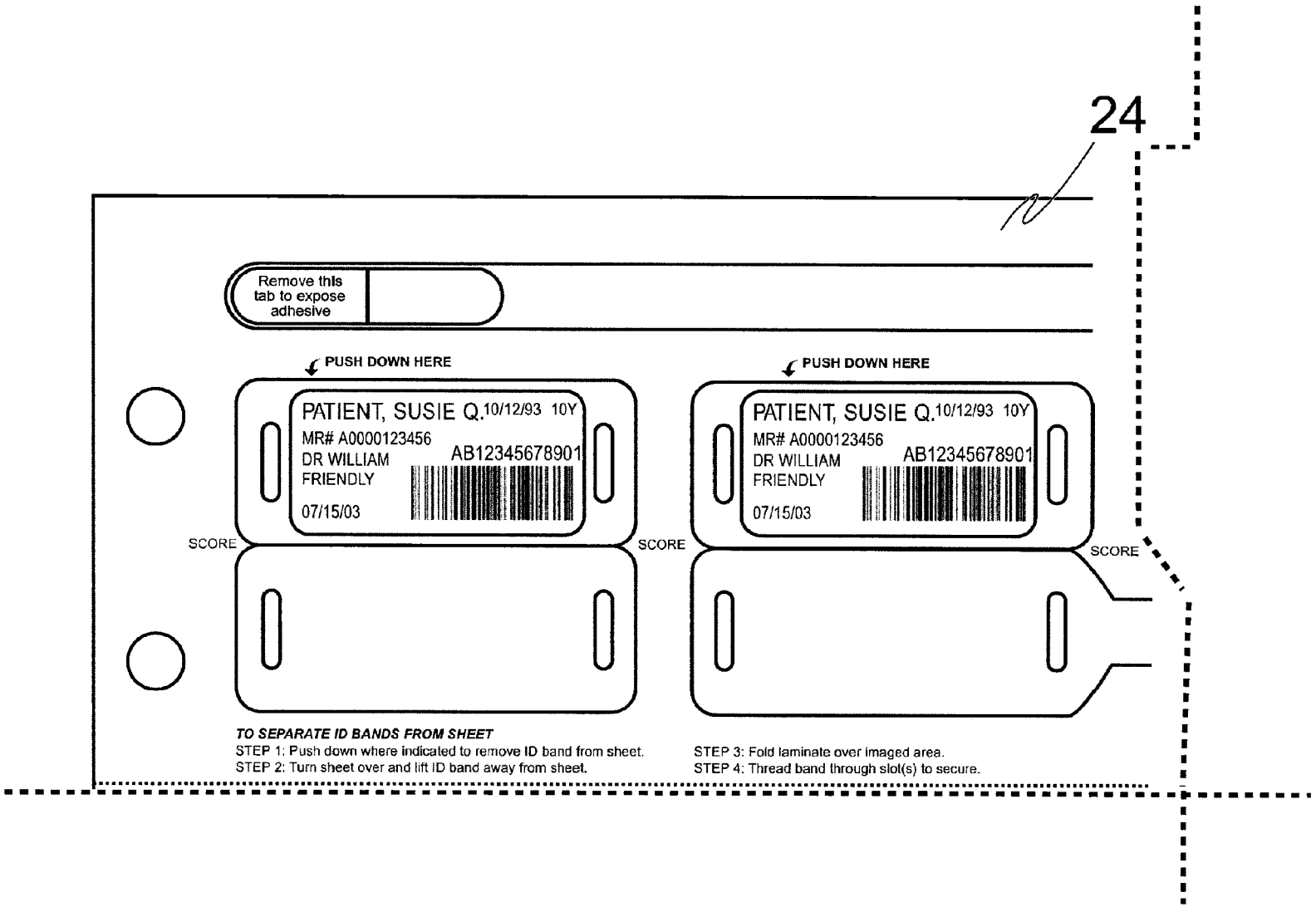
Figure 3C:
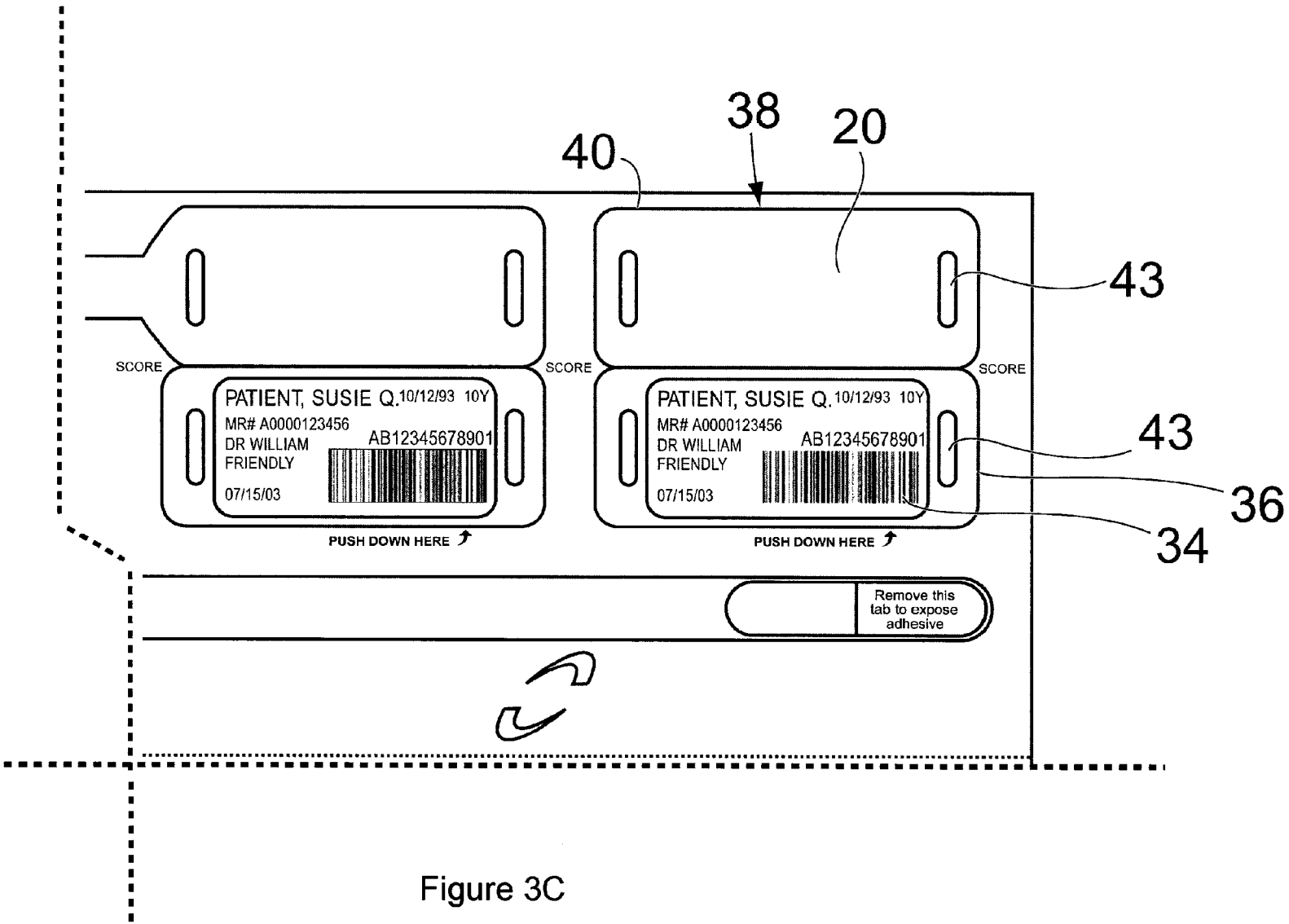
Figure 3D:
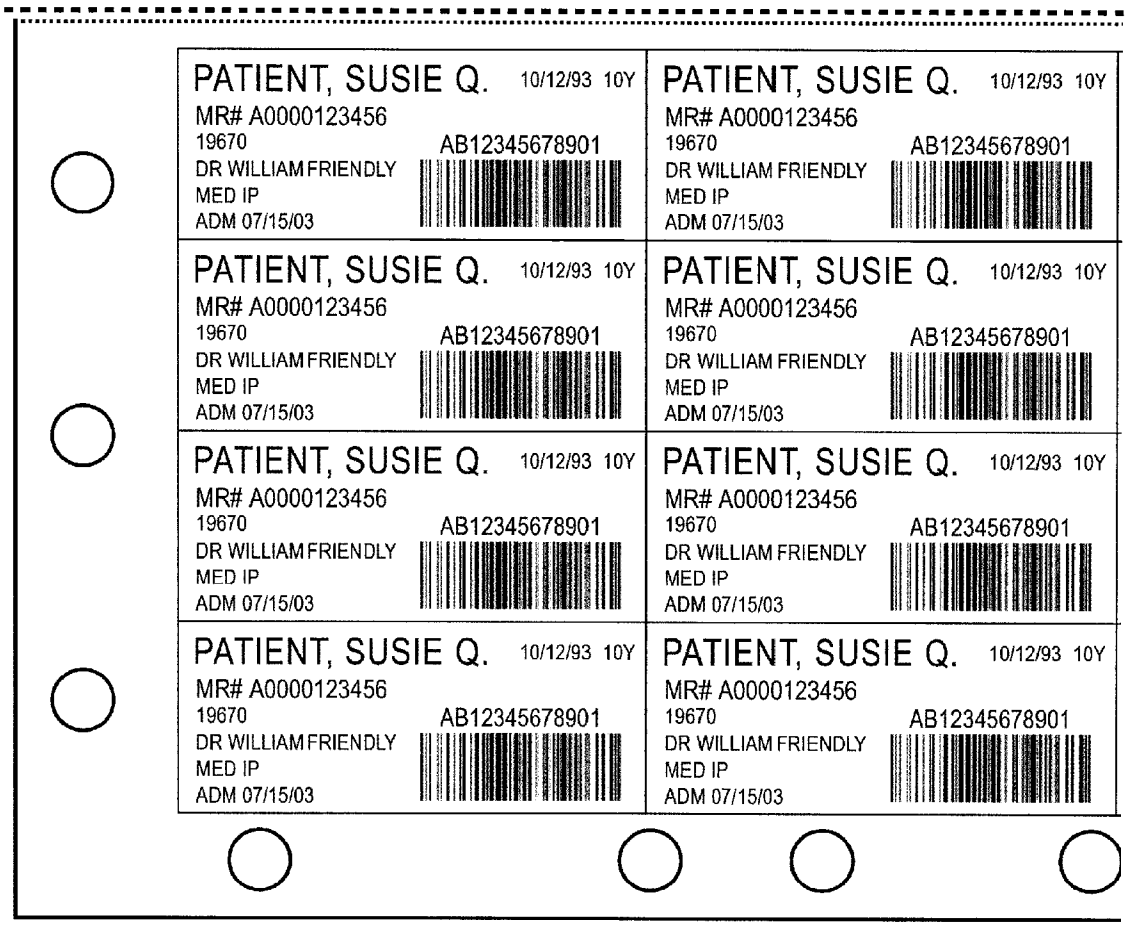
Figure 3E:
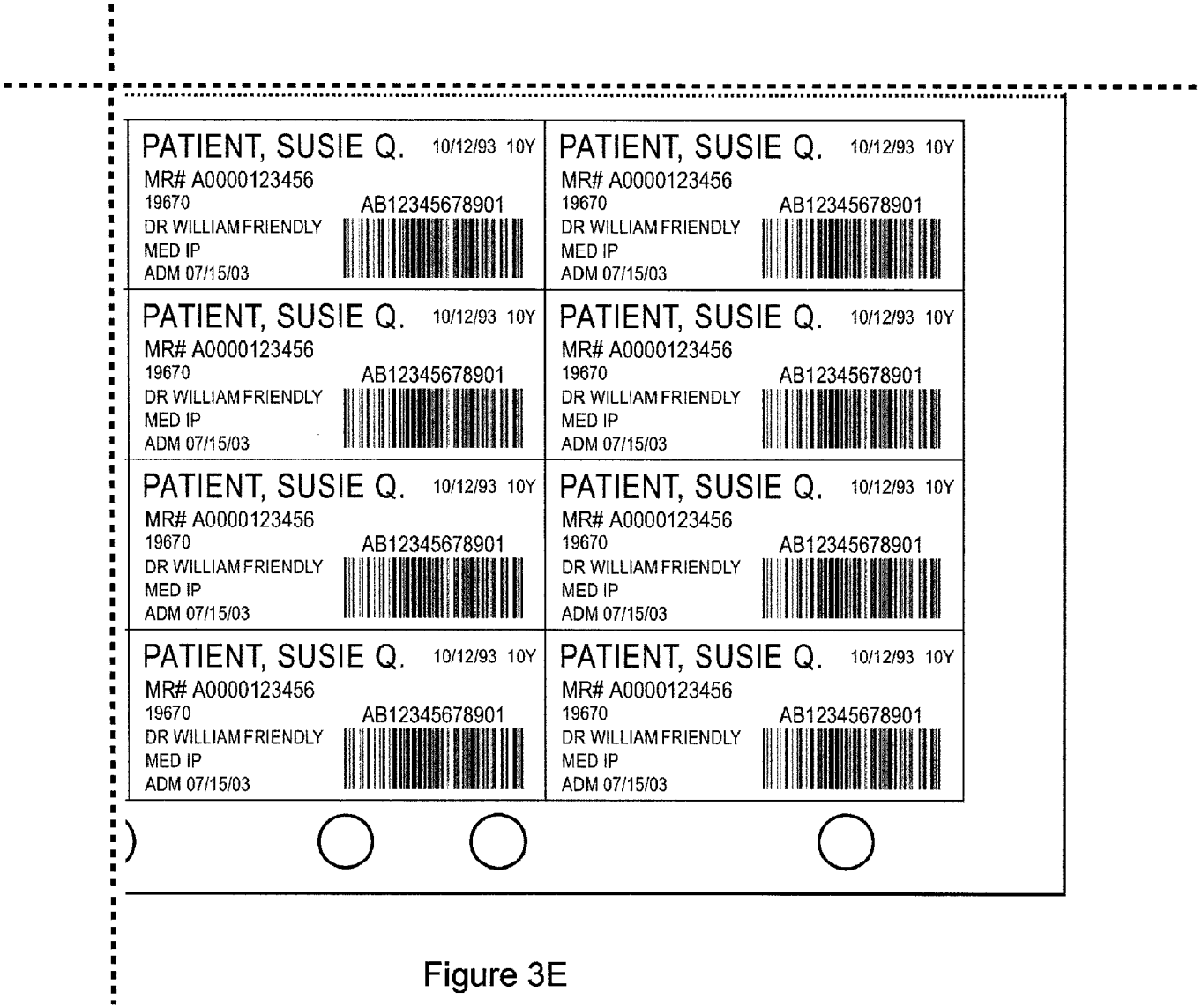

As shown in FIGS. 2(A)-2(C) and 3(A)-3(E), the self-laminating hang tag 20 is provided as part of a multi-web business form shown as a sheetlet 22 in FIGS. 2(A)-2(C) or a page sized combination form 24 as shown in FIGS. 3(A)-3(E). The sheetlet 22 is approximately envelope sized for convenient processing through a laser printer, as is known in the art and as explained in the inventor's prior patents mentioned above. The sheetlet 22 is generally comprised of two plies, an upper face ply 26 joined to an underlying laminate ply 28, the self-laminating portions of which are shown in outline 30 on the sheetlet 22. A pair of hang tags 20 as well as a pair of self-laminating wristbands 32 are conveniently sized to fit within the confines of the sheetlet 22. Of particular interest for purposes of the present invention are the hang tags 20. Each of these include an imaging area 34 defined by a die cut 36 in the face stock layer 26 and an underlying laminating portion 38 defined by a die cut 40 in the laminate layer 28. A pair of cinch slots 43 are preferably provided in the laminating portion 34 and straddling the imaging area 34. These cinch slots are used to attach the hang tag 20 to the carrier 44, as is explained below in greater detail. As shown in FIGS. 2(B)-2(C) and 3(B)-3(C), the cinch slots 43 may be approximately 7/16 inches long by approximately 1/16 inches wide and spaced approximately 1-3/4 inches apart, or otherwise appropriately sized to allow for the hang tag 20 to be slidingly attached, as explained below. More particularly, the inventor contemplates that the cinch slots 43 should be preferably sized so as to minimize the possibility for the hang tag 20 to shift once the wristband has been applied to the baby. The self-laminating hang tag 20 is conveniently separated from the sheetlet 22 and the lamination portion 38 is folded about a score line 42 to completely encapsulate the imaging area 34. Of course, the imaging area 34 may be processed through a laser printer and printed with patient information upon admittance of the patient or, as with the case of a baby, birth of the baby. In addition to being provided in sheetlet 22 form, the wristbands 32 and hang tags 20 may also be provided as part of a page sized combo form 24 as shown in FIGS. 3(A)-3(E). The construction of the combo form 24 is explained in greater detail in one or more of the inventor's prior patents as mentioned above.

Figure 1:
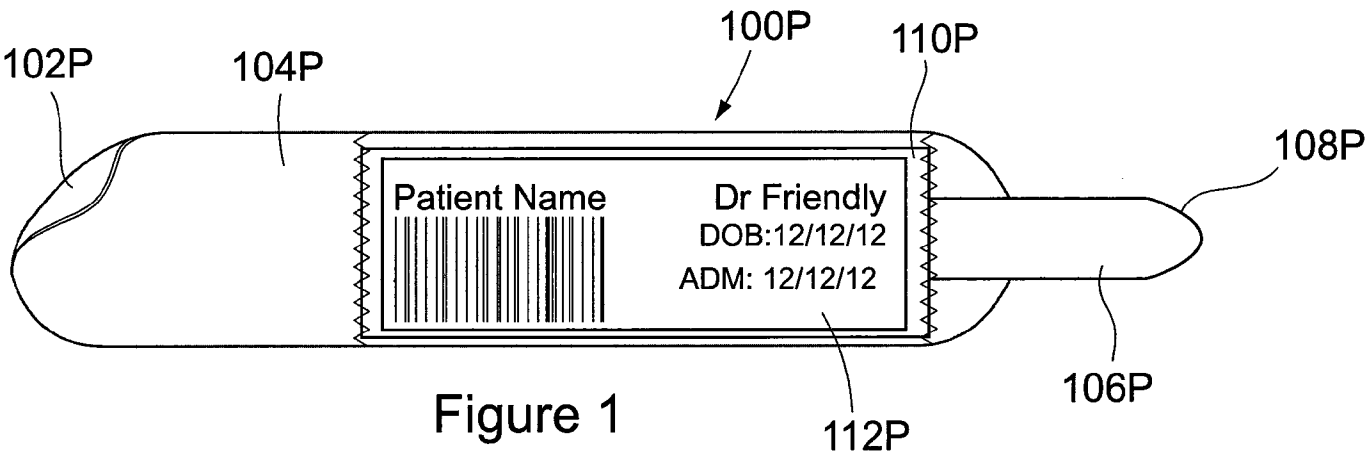
Figure 1 PRIOR ART
FIG. 1 is a plan view of a prior art wristband and label having a cushioning material carrier.
Figure 4:
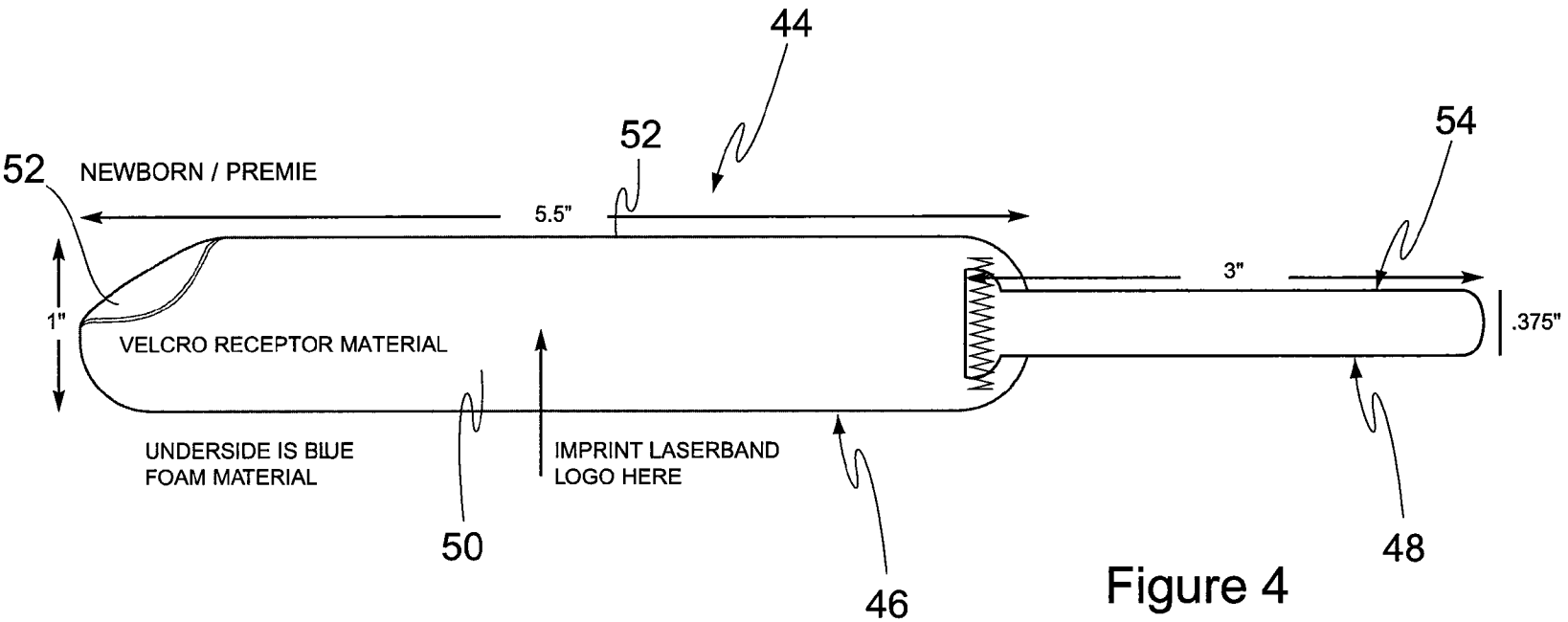
FIG. 4 is a top view of the cushioned carrier depicting the Velcro™ strap sewn to one side thereof for attachment of the self-laminating hang tags depicted in FIGS. 2(A)-2(C) and 3(A)-3(E)

The carrier 44 is shown in FIG. 4. It includes a band portion 46 and a strap portion 48. The band portion 46 is of multi-layer construction with a top layer 50 of the "loop half" of a Velcro™ fastener material and a bottom layer 52 of a cushioned material which is preferably any soft foam or sponge-like material which may also be of surgical grade. The Velcro™ strap 48 has a lower surface 54 comprised of the "hook half" of a Velcro™ fastener such that as the carrier 44 is wrapped around a baby's wrist, the Velcro™ hook surface 54 may be brought to overlie the Velcro™ loop surface and attach the two ends of the carrier 44 and complete the wristband.

As shown in the preferred embodiment, the strap portion may be preferably sewn on to the end of the carrier or band portion 46 and be approximately 3 inches long by 3/8 inches wide. The hang tag cinch slots 43 are sized appropriately to receive and pass the strap portion 48 therethrough and allow an end of the strap portion 48 to extend beyond the second cinch slot 43 for exposure to the loop portion 50.

Figure 5:
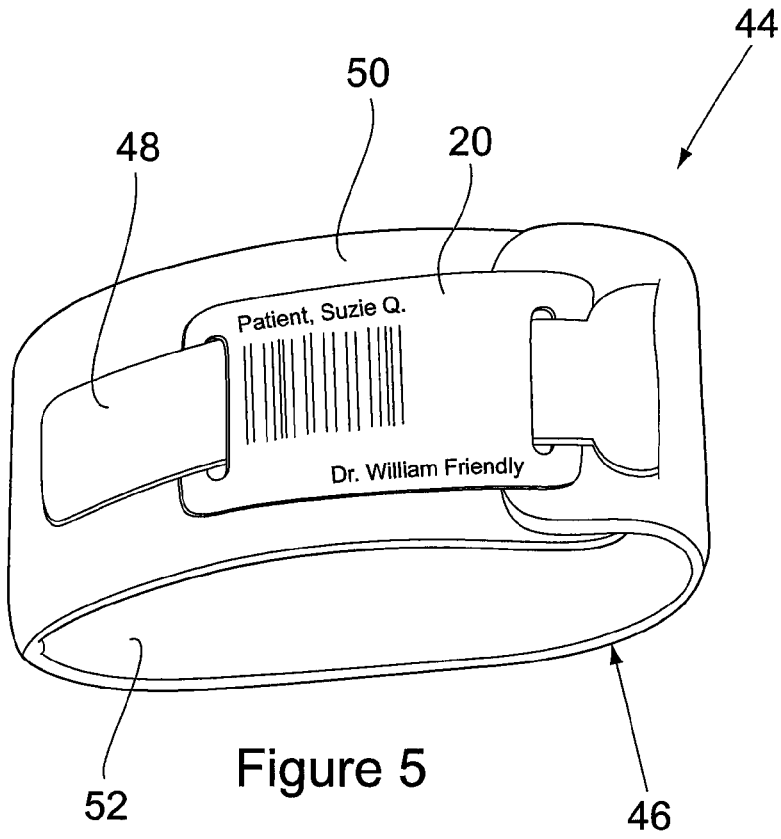
FIG. 5 is a perspective view of an assembled wristband with the strap threaded through both of two cinch slots.
Figure 6:
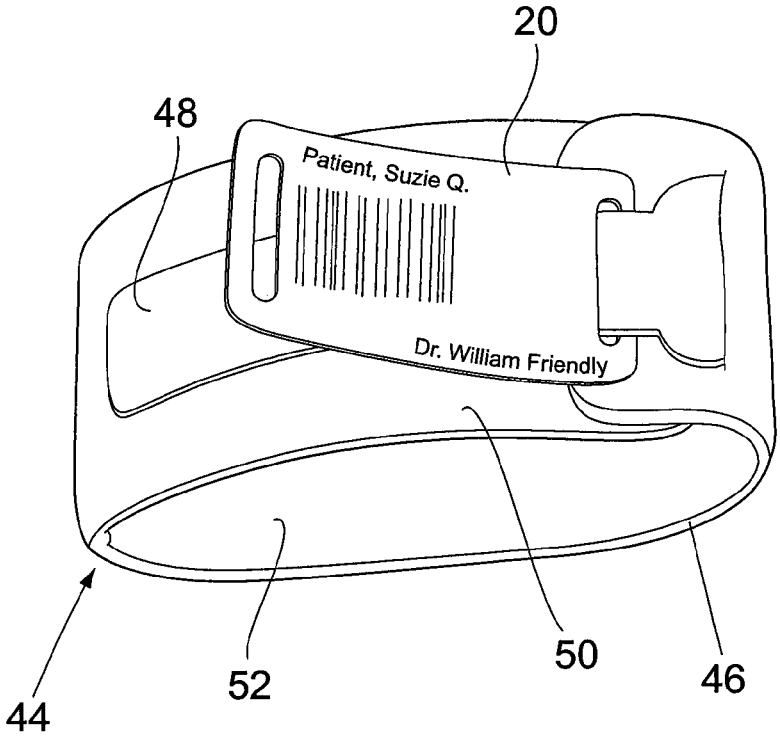
FIG. 6 is a perspective view of an assembled wristband with the strap threaded through one of the cinch slots.

In use, the hang tags in the form of a sheetlet or page sized form are conveniently processed through a laser printer or the like at which time the patient's name or other identifying information is applied to the imaging area. A hang tag may then be separated from the sheetlet or page sized form, and the carrier strap inserted through one or both of the cinch slots. As shown in FIG. 5, the hang tag may be positioned on the strap so that the extra length of the strap extends beyond the outboard cinch slot so that the maximum size "tongue" extends beyond for attachment to the loop material on the back of the carrier. Also, in FIG. 5 the carrier is shown as overlapping so that only the cushion material forming the carrier contacts the patient's skin. This arrangement is similarly shown in FIG. 7. With this arrangement, it is thought that maximum comfort is provided to the patient as the carrier may be "snugged" about the wrist, or ankle, so as not to be tight but to be firmly secured and yet just the cushion material is softly compressed against the skin. A second configuration is shown in FIG. 6, as the strap is threaded through only one of the two cinch slots. Although FIG. 6 shows the strap inserted through the inboard cinch slot, the strap may be similarly inserted through the outboard slot, depending on the choice of the nurse. One or the other of the slots might be chosen to facilitate access to a bar code on one side or the other of the hang tag, for example, or for any other reason including merely personal preference. Again, in FIG. 6 as in FIG. 5, the carrier is shown as overlapping, for maximum comfort. However, the carrier could be arranged to not overlap, for example should a longer length wristband be needed, although that application is not contemplated by the inventor as preferable as it possibly exposes rough edges and surfaces to the patient's skin.

Figure 7:
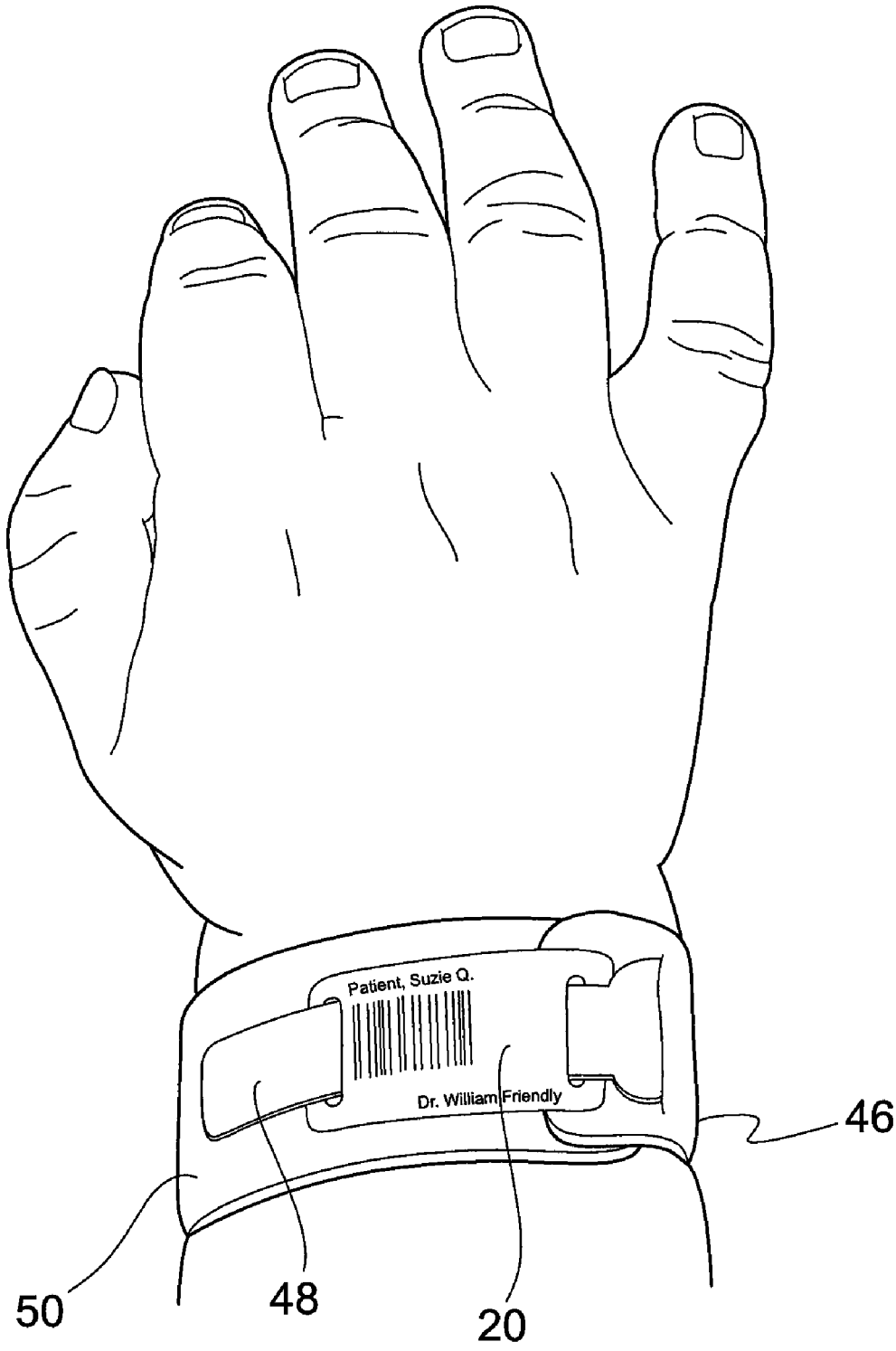
FIG. 7 is a perspective view of an assembled wristband applied to a patient's wrist.

As shown in FIG. 7, the wristband is conveniently arranged to encircle the patient's wrist, and may be "snugged" against the wrist to hold it in place, with the information on the hang tag exposed for ready viewing and access for example to read a bar code imprinted thereon. With this arrangement, the wristband will resist unintentional migration or movement which would obscure the patient information. However, as noted above, the length of the wristband compared to the size of the patient's appendage will in some cases limit the choice for applying the wristband in this overlapping configuration or not. While a short gap between the two ends of the carrier might well be acceptable due to the relative thickness of the carrier, too long a gap would potentially expose the "hook" surface of the strap to the patient's skin as well as shorten the amount of strap hook surface contacting the loop surface which might compromise the integrity of the attachment. Therefore, while the design of the wristband does provide some adjustability, some care must be used in choosing the right size wristband for the particular patient.

The invention has been described in terms of a preferred embodiment as shown in the drawings and described above. However, the invention should not be considered as limited to the specifics of this preferred embodiment as various changes and alternatives to the specific disclosure would be apparent to those of skill in the art and are included within the teaching of the invention. For example, various kinds of materials may be used for the band portion of the carrier, various dimensions and lengths can be chosen as convenient for the various portions of the carrier such as the band and the strap, the strap may be secured to the band portion by any convenient attachment means including a hook-and-loop fastener, snap, etc., the hang tag could be preprinted with information desired to be included, such as special precaution conditions or other warnings or indications relating to the medical condition or treatment of the patient, a cinch slot could be provided on only one side of the hang tag instead of both sides or moved to different areas on the hang tag, a wristband could function as a hang tag by cutting off the strap portion, and other similar changes. Furthermore, although explained as intended for principal use for baby patients, the wristband of the present invention may also be used for any patient for increased comfort and reduced risk of abrasion, rash, or unintentional injury for those patients with skin integrity issues such as burn victims, elderly patients, etc. As such, the present invention should only be considered as limited by the scope of the claims appended hereto and their legal equivalents.

What is claimed is:

1. A business form comprising a self laminating hang tag for attachment to a wristband, said business form having a first die cut therein defining a face ply portion of said hang tag for receiving a printed image and a second die cut therein defining a laminating ply portion for laminating the face ply portion after separation of said hang tag from said business form, said laminating ply having at least one cinch slot for attachment of said hang tag to said wristband, and said business form having at least one additional die cut defining said wristband therein.

2. The business form of claim 1 wherein said business form is comprised of only two plies, a top face stock ply wherein said first die cut defines the face ply portion and a laminating layer ply wherein said second die cut defines said laminating ply portion, said face ply portion being adhered to said laminating ply portion so that after said hang tag is separated from said business form said laminating ply portion is folded over to laminate said face ply portion and thereby form the hang tag.

3. The business form of claim 2 further comprising a die cut in said laminating layer ply defining a cinch slot in said laminating ply portion.

4. The business form of claim 3 further comprising a die cut in said laminating layer ply defining a second cinch slot in said laminating ply portion, said cinch slots being positioned on opposite ends of said hang tag.

5. The business form of claim 2 wherein said laminating ply portion comprises a pair of panels having substantially the same size and arranged to be folded over onto each other to thereby encapsulate and laminate the face ply portion.

6. The business form of claim 5 further comprising a plurality of die cuts in said laminating ply portion defining a pair of cinch slots in said hang tag, said cinch slots being arranged to straddle the face ply portion in the finished hang tag.

7. A business form comprising a two ply page, said two plies comprising a top face ply and a bottom laminate ply, a die cut in the face ply defining a face ply area and at least one die cut in the laminate ply defining a laminating portion for each of a self laminating wristband and a self laminating hang tag, each of said face ply areas being adhered to their associated laminating portions, and a plurality of die cuts in said laminate ply defining at least one cinch slot in said hang tag, each of said laminating portions being positioned and sized with respect to their associated face ply areas so that upon separation from said business form along the die cuts the laminating portions are folded over their associated face ply areas to separately laminate them and thereby form said self laminating wristband and said self laminating hang tag.

8. The business form of claim 7 wherein a pair of cinch slots are defined by said die cuts in said laminate ply, said cinch slots arranged to straddle the hang tag face ply area.

9. The business form of claim 8 wherein said each of said laminating portions comprises a pair of substantially similar size panels separated by a fold line so that said panels may be folded over onto themselves to laminate their associated face ply areas.

* * * * *